US005104567A

United States Patent [19]

St hr

[11] Patent Number: 5,104,567

[45] Date of Patent: Apr. 14, 1992

[54] LIQUID FOR CLEANING OFF INK FROM PRINTING MACHINES

[75] Inventor: Henrik Staehr, Rodovre, Denmark

[73] Assignee: A/S Alaska Gruppen, Hvidovre, Denmark

[21] Appl. No.: 499,581

[22] Filed: Mar. 27, 1990

[51] Int. Cl.[5] ..... C11D 3/22

[52] U.S. Cl. ..... 252/174.17; 252/162; 252/170; 252/174.25; 252/351; 252/DIG. 5; 252/DIG. 14; 424/70; 514/846; 514/904; 514/944; 514/942; 514/943; 426/601; 426/606; 426/611

[58] Field of Search ..... 252/162, 89.1, 174.17, 252/174.22, DIG. 5, DIG. 13, DIG. 14, DIG. 19, 143, 174.15, 170, 173, 174.12, 174.21, 117; 426/601, 606, 611; 424/70; 514/846, 904, 944, 942, 943

[56] References Cited

U.S. PATENT DOCUMENTS 4,504,406 4/1985 Dhillon ..... 252/162
4,707,293 11/1987 Ferro ..... 252/174.17

*Primary Examiner*—Paul Lieberman
*Assistant Examiner*—Kevin D. McCarthy
*Attorney, Agent, or Firm*—Fleit, Jacobson, Cohn, Price, Holman & Stern

[57] ABSTRACT

An environmentally acceptable cleaning liquid for use in the graphic industry consisting of 90–99% of a vegetable oil, in particular soy oil, and 1–10% of a surfactant emulsifier. The liquid is suitable for removing ink from printing machines where it is capable of replacing the traditional cleaning liquids based on petroleum spirit and aromatic solvents. As the liquid does not contain any health hazardous components it is completely safe to work with, and due to its bio-decomposable character it is disposable without problems. Because of its excellent penetration properties the liquid is also suitable for cleaning off machine parts which otherwise are difficult to clean, e.g. rubber sheets.

4 Claims, No Drawings

LIQUID FOR CLEANING OFF INK FROM PRINTING MACHINES

The present invention relates to an environmentally acceptable cleaning liquid for use in the graphic industry. In particular the invention relates to a liquid for cleaning off ink and printing ink from printing machines, and the liquid according to the invention is characterized by consisting of 90–99% of a vegetable oil and 1–10% of an emulsifier The liquid of the invention is particularly useful in the printing industry for cleaning off offset screens, rubber sheets, and ink rollers, as it is capable of replacing the traditional organic and aromatic solvents.

Cleaning off or washing off printing inks from printing plates, rollers and other machine parts within the graphic industry has until now been effected by means of cleaning liquids which either contain dangerous substances or low boiling aromatic solvents, the use of which entails considerable risks to the individuals handling the substances. In particular for the cleaning off of dried-up ink residues in offset printing use was in the past especially made of petroleum spirit or aromatic compounds, such as xylene or toulene based agents, whose health effects are well-known. Such compounds are extremely volatile and in addition frequently exhibit very low flash points. Thus, these liquids ignite easily, and as a consequence of the high volatility they also constitute an increased potential health risk through aspiration of vapours.

Because of the health hazardous aspects and general environmental problems related to the use of petroleum spirit and other mineral oil products and aromatic solvents it has lately been strived at to use less dangerous cleaning agents, not least as a consequence of the growing concern that aromatic solvents may provoke dementia and other brain damages following long-term exposure. The problem has been to find cleaning liquids posing negligent or no health risk at all and being just as efficient as the traditional cleaning liquids as regards removal of ink from printing machines.

U.S. Pat. No. 4,836,950 discloses liquids for removal of printing and screen printing inks, the liquids consisting of γ-butyrolactone and/or N-methyl-2-pyrrolidone, one or more propylene glycol derivatives and diluents and/or surfactants. These cleaning liquids are less health hazardous than the traditional cleaning liquids, and furthermore distinguish themselves by being lenient to the glue system of the screen printing frames. According to that invention use of aromatic compounds is avoided, but the use of organic compounds posing a certain health risk is not completely eliminated.

Vegetable oils, fatty acid esters and like compounds have for some time been used for various cleaning purposes. U.S. Pat. Nos. 4,176,080 and 4,180,472 disclose detergent compositions and methods for removing oily soils from fabrics in an aqueous washing process. The compositions consist of 20–97% alkanes or fatty acid esters and 3–30% of emulsifiers. The concentration of the alkanes or fatty acid esters is from about 0.1 to about 3% in the aqueous washing medium.

EP published patent application No. 0 307 024 A1 describes a de-inking agent for waste paper. The agent is an aqueous fatty acid-containing anionic dispersion which essentially contains saturated fatty acids, anionic surfactants as well as mono- and/or diesters of polyvalent alcohols of fatty acids having an HLB value (hydrophilic lipophilic balance) of from about 3 to about 7. A preferred fatty acid is palmitic acid. A particularly suitable ester is commercial glycerin monostearate having a monoester content of 45–60%. Use of the agent in de-inking results in a considerable improvement of the degree of whiteness of the remaining fibres and a reduction in the fibre loss during flotation.

British Patent Specification No. 1 240 769 discloses an aqueous composition suitable for cleaning metal, glass and painted surfaces. The composition contains inorganic or organic acids, for instance 50% concentrated phosphoric acid, cationic emulsifiers and small amounts of oily substances, for instance fatty acid esters, which are added to increase the viscosity of the composition and increase the adhesive properties. The composition may be diluted with water before application in a ratio of from 1:2 to 1:10 by volume.

Japanese Patent Specification No. 81 035 716-B discloses a non-aqueous composition and method for removing scales of soap on the inside wall of heat exchangers. The composition consists of a mixture of fatty acids and their methyl esters, and the cleaning is performed at 100°–130° C.

Within the graphic industry it has previously been tried to used pure liquid fatty oils, e.g. soy bean oil, for cleaning off ink from offset printing machines. However, the results have not been satisfactory, as usually it has been necessary to rub the rollers forcefully with a cloth in order to make the oil dissolve all the ink, and it has often been necessary to repeat the process several times to make the rollers clean. This is caused partly by the high viscosity of the oil, partly by the low dissolution rate. Furthermore it has in practice been impossible to obtain clean rubber sheets by cleaning off with vegetable oil, as it is difficult for the oil to penetrate into the pores of the rubber.

It has now surprisingly been found that an extremely fine cleaning of printing machines can be achieved by using as cleaning liquid a mixture consisting of 90–99% of a vegetable oil and 1–10% of an emulsifier. Such a mixture yields an easy and uncomplicated cleaning off of printing ink from all machine parts, also from difficult-to-access machine parts and rubber sheets as a consequence of the surprisingly fine penetration properties of the liquid. The health risks related to the use of traditional aromatic solvents and kerosene based cleaning liquids are completely eliminated, and there are no vapour or odour problems related to the use of these new cleaning liquids at normal working temperatures. In addition, the liquids of the invention do not present problems by normal contact with the skin. By washing hands and skin which have been in contact with the liquid with water and soap, any risk of irritation and eczema and other skin diseases is eliminated.

The novel cleaning liquids according to the present invention are not subject to compulsory marking in accordance with the marking rules of the Environmental Protection Agency, and no special occupational hygienic measures are demanded when working with the liquids. The liquids are furthermore biologically decomposable and consequently pose no disposal problems.

The cleaning liquids according to the invention are water emulsifiable and consequently easy to rinse off with water.

The main component in the cleaning liquids according to the invention is a vegetable oil. The preferred oil is soy oil, but also other vegetable oils may be used, e.g. grape oil, coconut oil, palm-kernel oil, sunflower oil and grape-kernel oil.

The other component is an emulsifier having surfactant properties. The choice of emulsifier is not critical. A suitable emulsifier is Berol 799 from Berol Kemi AB, Sweden, being a selfseparating emulsifier for cold-degreasing agents. It essentially consists of oleyl amine ethoxylate and non-ionic tensides, which do not constitute any particular health problems. The fact that the emulsifier constitutes 10% at most of the cleaning liquid further eliminates the already insignificant health problems.

The cleaning liquids according to the invention are easy and uncomplicated to use. When washing off offset plates and rubber sheets the liquid is applied to a clean dry cloth, whereafter the subject is wiped and wiped again with a water-moistened cloth. Hot or cold water may be used. After washing off wiping is performed with a clean dry cloth. When washing off ink rollers in machines having a washing system, the liquid is applied to the ink rollers which are then made to rotate until they are clean. Rinsing is then performed with water. Hot or cold water may be used.

The cleaning liquids of the invention are easily produced by simple mixing of the components. A preferred liquid is produced by apportioning 950 l soy oil in a mixing tank and adding 50 l Berol 799 emulsifier with stirring. The stirrer is allowed to run for 15 min, whereafter 1000 l of product are ready for drawing off.

The cleaning liquids according to the invention have been subjected to extensive testing in 19 printing houses for 1 ½ years. This testing has shown that the liquids are more easy and more uncomplicated to work with than traditional cleaning liquids, and that they do not entail any nuisances to the persons working with the liquids.

It is claimed:

1. A process for cleaning off ink from printing machines, comprising the steps of:

applying a cleaning liquid to a part of the printing machine to be cleaned, consisting of 90–99% of a vegetable oil and 1–10% of an emulsifier; and removing the cleaning liquid.

2. The process of claim 1, wherein the vegetable oil is soy oil.

3. The process of claim 1, wherein the emulsifier consists of oleyl amino ethoxylate and non-ionic tensides.

4. The process of claim 3, wherein the cleaning liquid consists of 95% soy oil and 5% of an emulsifier.

* * * * *